United States Patent [19]

Rowland

[11] 4,366,980

[45] * Jan. 4, 1983

[54] STACKABLE ARMCHAIR

[76] Inventor: David L. Rowland, 8 E. 62nd St., New York, N.Y. 10021

[ * ] Notice: The portion of the term of this patent subsequent to Dec. 8, 1998, has been disclaimed.

[21] Appl. No.: 157,682

[22] Filed: Jun. 9, 1980

Related U.S. Application Data

[63] Continuation-in-part of Ser. No. 46,836, Jun. 8, 1979.

[51] Int. Cl.[3] ..... A47C 3/04

[52] U.S. Cl. ..... 297/239; 297/445

[58] Field of Search ..... 297/239, 248, 445, 411; D6/67, 72

[56] References Cited

U.S. PATENT DOCUMENTS

| | | | |
|---|---|---|---|
| D. 178,096 | 6/1956 | Van Koert | D6/67 |
| D. 235,709 | 7/1975 | Schier | D6/72 |
| 207,764 | 9/1878 | Mitchell | 297/411 X |
| 1,989,426 | 1/1935 | Pollak | 297/239 |
| 2,642,118 | 6/1953 | Lamb | 297/239 |
| 3,446,530 | 5/1969 | Rowland | 297/239 |
| 3,845,986 | 11/1974 | Rowland | 297/239 |
| 3,979,098 | 9/1976 | Vattier | 211/135 |
| 4,304,436 | 12/1981 | Rowland | 297/445 |

*Primary Examiner*—Francis K. Zugel

*Attorney, Agent, or Firm*—Owen, Wickersham & Erickson

[57] ABSTRACT

A stacking armchair and a metal chair frame therefor. One frame member has an U-shaped, horizontal portion and a pair of vertical front legs. The horizontal portion comprises a lateral rear portion and horizontal side portions that lie generally parallel to each other, but diverge somewhat from rear to front. Each of two flanged frame juncture members has a horizontal top and a pair of vertical side flanges; the top has a pair of horizontal edges and each side has a pair of vertical edges. One horizontal edge and two vertical edges of each are welded to the frame side portions adjacent the rear lateral portion. Each of a pair of rear legs with integral back-support portions is welded to the other horizontal and vertical edges, so that they are spaced apart from each other farther than are the front legs. They provide nearly parallel back-support portions that diverge slightly from each other. To these, along mating sloping faces are welded arm members. A seat (preferably non-rigid and resilient) bridges and is secured to the frame side portions and urges them toward a truly parallel relationship, and a similar back bridges and is secured to the back-support portions and, urges them toward a truly parallel relationship.

31 Claims, 30 Drawing Figures

64
65
S
64
65
65
64
62
D1
D2

64
84
H1
H2
67
88
86
62
64
S
67
67
64
69
66
62
62
62

S 65
79
80
84
83
67
85
86
62
64
69
85
79
62
86
84
88
79
64
87
67
19

19
65
69
64
80
84
18
18
83
88
87
67
62

67
66
114
112
113

67

112
66
113
114
H 54
55
56
57
58
60
61
62
63
64
65
66
67
70
71
72
73
74
75
100
101
H

STACKABLE ARMCHAIR

Except for the arms, the armchair of this invention utilizes the structure of my invention shown and claimed in U.S. patent application Ser. No. 46,836, filed June 8, 1979, and therefore is a continuation-in-part application thereof.

BACKGROUND OF THE INVENTION

This invention relates to an improved armchair and to an improved stacking armchair and to a frame therefore.

As stated in that earlier application, stackable chairs have heretofore usually been so designed that when nested in a stack there was considerable vertical space between them, often two or three inches. As a result, only a few chairs could be put into one stack; moreover, stacking them and removing them from the stack was difficult. Compact stacking has been rare; although it has been achieved with special structures. Compact stacking of armchairs has been even rarer.

Another difficulty with many stackable chairs was that in each the frame was made up of several frame members. If these frame members were strong, they were usually relatively heavy; if they were light in weight, they were usually not sufficiently strong. Such chairs usually required a front horizontal stretcher to provide sideways stability, especially when the leg members were thin. This sometimes was uncomfortable in that the back of the sitter's legs would hit this front horizontal stretcher bar.

Heretofore, stackable chairs were especially heavy because they required such extra frame members. Stackable chairs made of steel tubing heretofore typically required either a stiff frame member or stiff shelf portion across the top of the back and another stiff frame member or stiff shelf portion across the front of the seat. As an alternative, the seat and the back had to be so rigid that they would provide the needed strength. The more rigid the seat or back was, the less comfortable it was.

Another problem with stackable chairs was their rigidity. This problem relates even to the chair disclosed in my earlier issued U.S. Pat. No. 3,845,986, which is otherwise excellent. In other chairs, too, rigid members or portions at the top or across the seat or across the legs added to the discomfort of the user. In some cases, a top bar across the back is convenient to the people who move the chairs from one place to another, but it does detract from the comfort if the sitter's back can come against it. Such rigidity was thought necessary to strength and stability, but it has tended to prevent a chair from being able to level itself on uneven floors. This has had particular disadvantages when such chairs were used in outdoor cafes, where stackability is very desirable, but where the ability of the legs to level to uneven surfaces made the chairs awkward, uncomfortable, or annoying to the users. Conventional rigid frame chairs have tended to rock on such uneven surfaces and, therefore, to bring the chairs into the minds of the users far too often.

Heretofore, stackable chairs, when stacked, have usually resulted in the frame of one coming against the frame of the other. Often this had done so in a manner such as to scratch the frames or to scrape off their finish. If they were spaced apart vertically so as to protect the finish so much space was left that the stack could not be compact, as remarked earlier.

Among the objects of the present invention are those of solving the problems enumerated above. Thus, it is an object of this invention to provide a comfortable, compactly stackable armchair; to provide a stackable armchair that does not need to incorporate a front, horizontal, rigid stretcher, especially one between the legs; an armchair that is not completely rigid so that it can flex sufficiently to accommodate itself to an uneven floor; to provide a stackable armchair which can be relatively light in weight; and to provide a stackable armchair in which the frame members of each are protected from scratching and from rubbing together.

Other objects and advantages of the invention will appear from the following description.

SUMMARY OF THE INVENTION

The invention comprises a stackable armchair and a frame for such an armchair. The frame includes a main frame element comprising a U-shaped horizontal portion and a pair of vertical front legs. The U-shaped portion has a rear, horizontal cross or lateral portion, joined at each end by a corner to a horizontal side portion, each of which is respectively joined by a corner to a front leg. The front legs are substantially parallel to each other, and the side portions are generally parallel to each other but diverge slightly from rear to front.

The frame also includes a pair of rear legs, two separate members, each with a back-support portion in line with the rear leg but preferably curving slightly rearwardly. The back-support portions are generally parallel to each other, but they preferably diverge slightly as one moves upwardly.

These frame members are secured together by a pair of cupped frame juncture and spacing members, each of which is shaped as a generally triangular-looking cup with a horizontal top and a pair of vertical depending sides. The top has a pair of horizontal edges and each vertical side has a pair of vertical edges at each end. A wider horizontal edge and two of the vertical edges are welded to the sides of the main frame element adjacent to the corners by which the cross member merges into the side members, thereby providing sidewise spacing. The other horizontal edge and two vertical edges are each welded to a rear leg. This places the rear legs and back-support portions outside the front legs, so that they are sufficiently farther apart from each other than are the front legs, thereby making the chair stackable so far as these members are concerned.

The frame is completed by a pair of arm members, one at each side, with a rear portion extending down from the upper ends of the back-support members and a generally horizontal front portion extending about half of the rear-to-front extent of the armchair frame. To enable rigid attachment, the back-support members are provided with an oblique edge that lies along a nearly vertical plane, and the rear portion of the arm member has a matching surface and extends somewhat forwardly as well as primarily vertically. The inner edges of the arms are outboard of the outer surface of the rear legs, to enable compact stacking, but they are generally parallel to each other, though they may diverge slightly.

A seat, preferably non-rigid and resilient, bridges and is secured to the two side portions of the frame and urges them toward a truly parallel relationship, while, similarly, a back, also preferably non-rigid and resilient, bridges and is secured to the two back-support portions and urges them toward a truly parallel relationship. These seat and back portions may be made from the materials shown in U.S. Pat. Nos. 3,720,568 and 3,843,477. When that material is used (usually sold under the name SOFLEX®) then an especially comfortable and resilient seat is obtained. The SOFLEX® seat or back may be covered or encased in additional fabric.

To prevent the frame members from becoming scratched during stacking, each frame side portion may be provided with two plastic members secured to or projecting from a lower surface of the side portions, one preferably near the front and the other preferably near the rear. One of these faces inwardly and the other faces outwardly, to provide a kind of locking engagement, effective to space the successive chairs slightly apart so that they rest on these non-scratching plastic members but are still compactly stacked.

The frame elements are metal and all, including the arms, may be made of the same tubular stock, if desired. When tubular stock is used, a bottom glide may be inserted into the tube and may comprise a plastic member with an outer portion substantially the same diameter as that of the leg.

If somewhat more security against inward collapsing of the seat portion is desired, this can be achieved without losing the flexibility of the frame by a steel rod or tube bridging between the forward parts of the side portions but not rigidly connected to them. The rod fits into a respective opening through a wall of a side portion and may bear against the wall opposite to the opening, but the rod is not welded to the side portions, so that the rod is still free to move somewhat in the opening, thereby enabling the frame to flex. For that purpose, the opening is made somewhat oversize.

Other features will appear from the following description.

DESCRIPTION OF SOME PREFERRED EMBODIMENTS

The armchair in general (FIGS. 1–6)

Figures 1, 2:
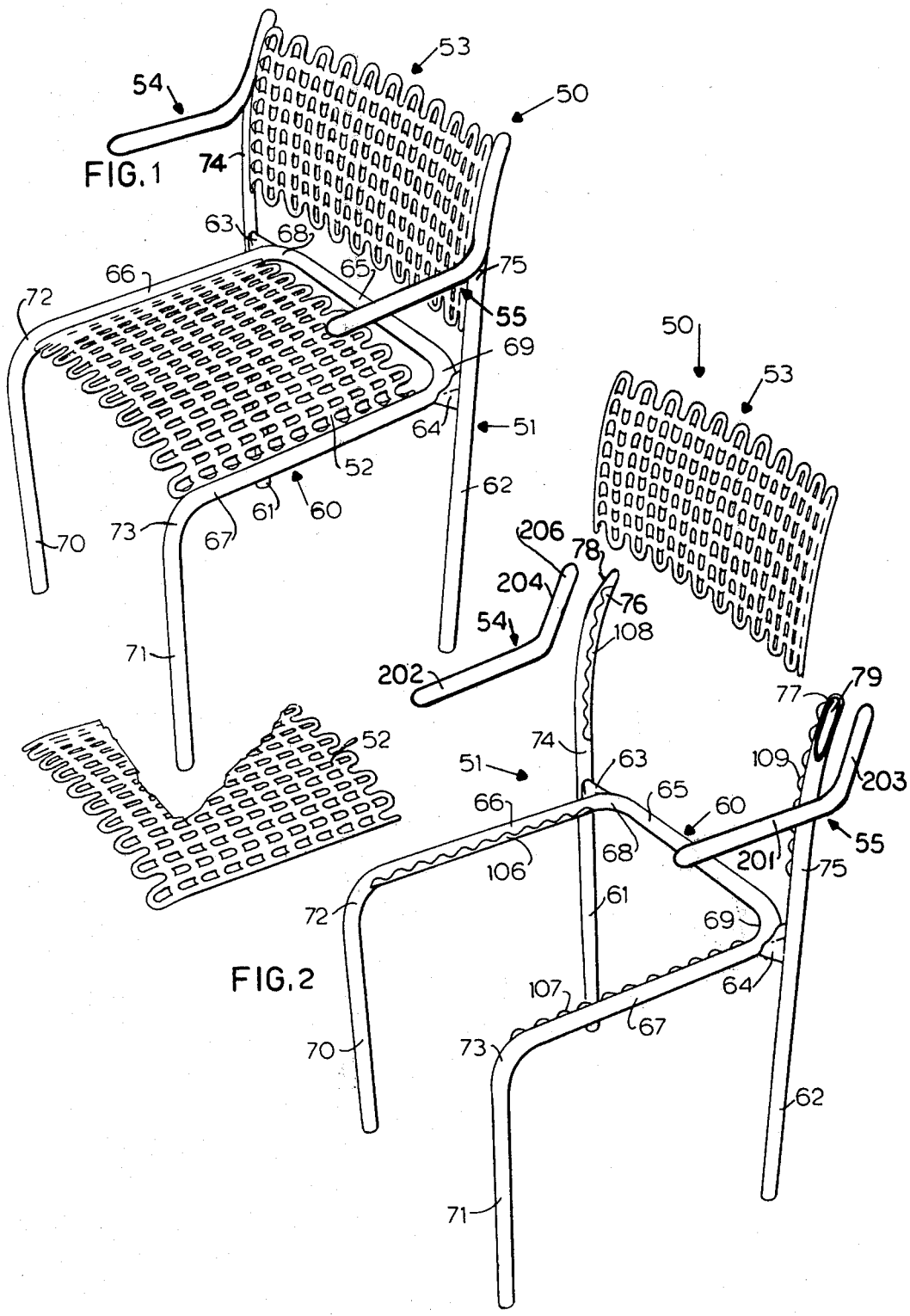
FIG. 1 is a view in perspective of an armchair embodying the principles of the invention and incorporating an armchair frame embodying the principles of the invention.
FIG. 2 is a partially exploded view of the armchair of FIG. 1 showing the assembled armchair frame and, separated, the seat and the back; the seat member has been broken off to conserve space.

FIG. 1 shows in perspective a stacking armchair 50 embodying the principles of the invention. As can be seen from this view and from FIGS. 2 and 3, the armchair 50 has a frame assembly 51, a seat 52, a back 53, and a pair of arms 54 and 55. The seat and back assemblies, as has been said earlier, employ the structure shown in my U.S. Pat. Nos. 3,720,568 and 3,843,477. This is preferred because that structure is excellent for seats and backs; however, as will be seen later, it is not essential.

Figure 5:
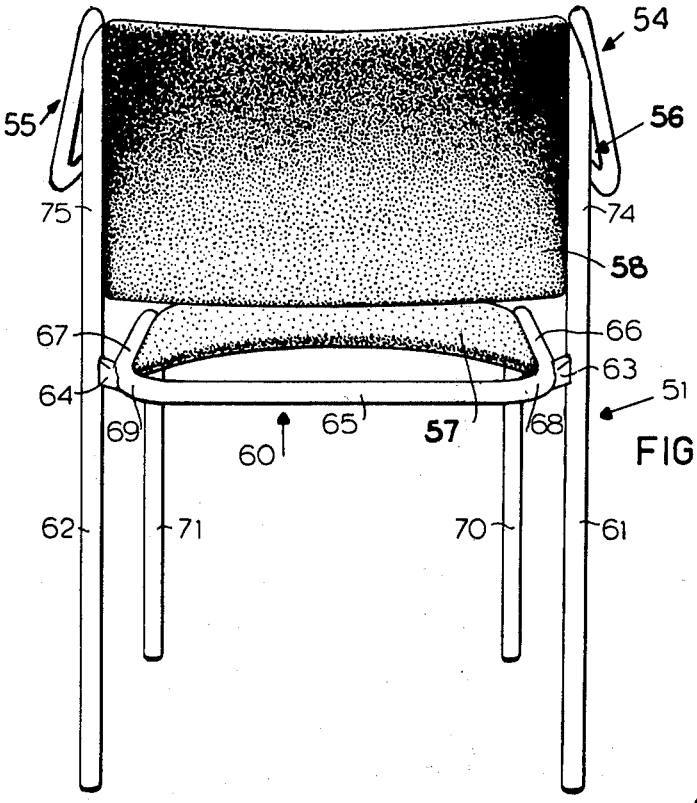
FIG. 5 is a perspective view from behind and above showing an armchair employing the same frame as that of FIG. 1 but with a modified seat and back.
Figure 6:
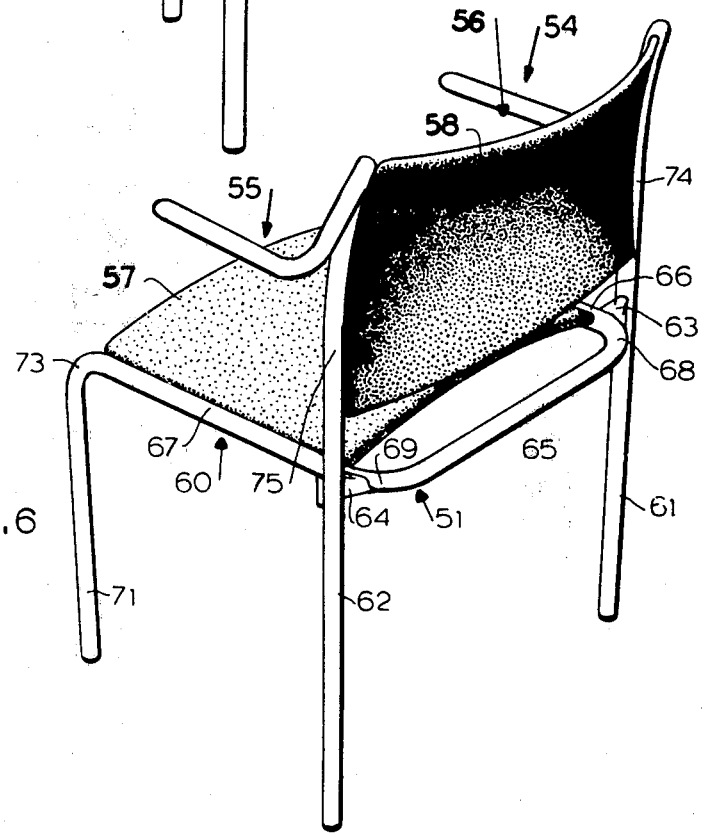
FIG. 6 is a view in perspective of the armchair of FIG. 5, looking from the rear.

FIGS. 5 and 6 show a stacking armchair 56 very much like the armchair 50 and incorporating the frame assembly 51 and arms 54 and 55 but having a modified form of seat 57 and back 58. The seat 57 and back 58 may actually be the seat 52 and back 53 encased in a fabric covering, either with or without some additional foam or plastic foam upholstery. However, they may represent a different kind of seat and back.

Figure 3:
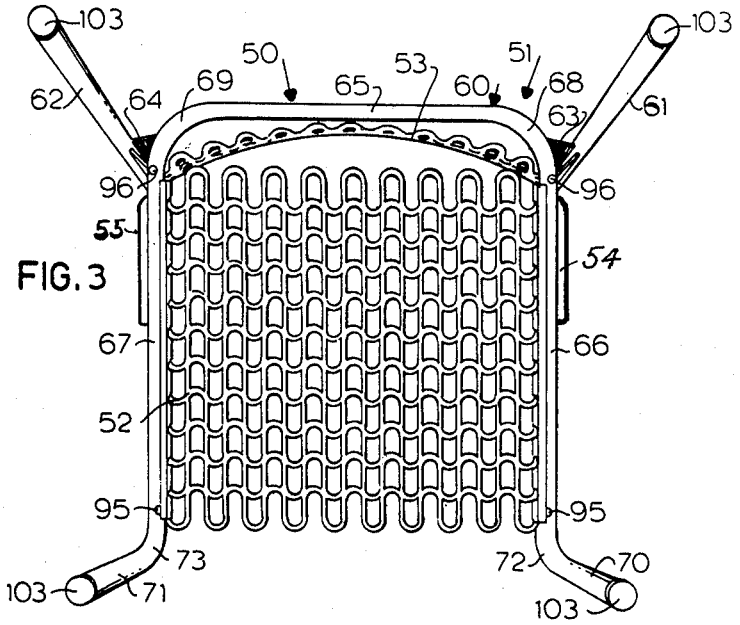
FIG. 3 is a bottom view of the armchair of FIG. 1.

These views show that the frame 51 of this invention is adapted to many different kinds of seat and back arrangements. As will be seen later, however, it is more desirable to have the seat and back be of non-rigid material than it is to have them of rigid material. The seats 52 and 57 are the backs 53 and 58 are especially comfortable and are highly recommended whether as shown in FIGS. 1 to 3 or whether incorporated in a fabric case so that they would appear as in FIGS. 5 and 6. The use of simple fabric seats is also feasible, as is the use of wood, plastic, or metal seats.

The frame assembly 51 (FIGS. 3, 5, and 7–19)

Figure 7:
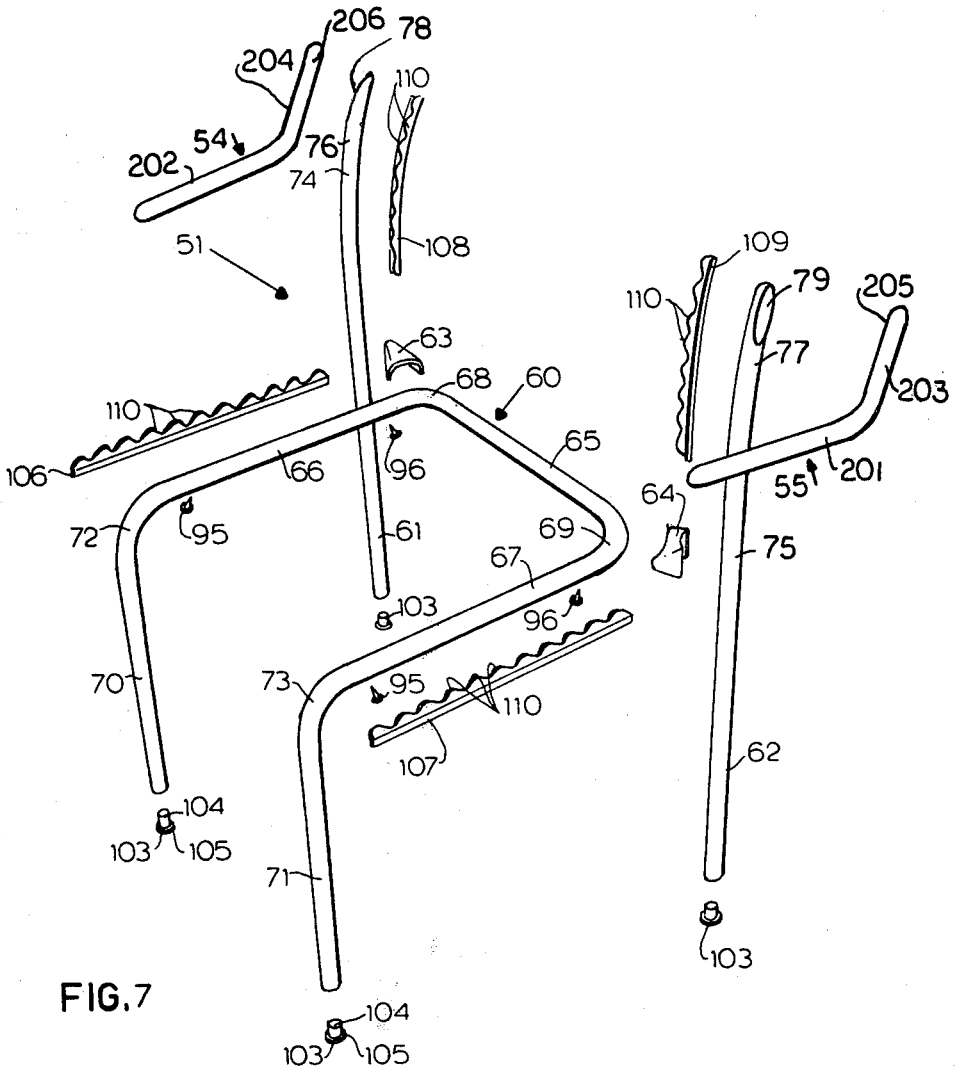
FIG. 7 is an exploded view of the frame of the armchair of FIG. 1, showing each element separately.

FIG. 7 is an exploded view of the frame assembly 51 and shows all the elements of that frame. The frame assembly 51 includes as principal ingredients a main frame element 60, two other frame elements 61 and 62 which comprise the rear legs, two frame-connecting-and-spacing members 63 and 64, and the arms 54 and 55.

The main frame member 60 has a horizontal U-shaped portion from which the front legs depend. Thus, it has a rear horizontal cross, lateral, or stretcher member 65 joined to side rail portions 66 and 67 by rounded corners 68 and 69; and these side members 66 and 67 are joined at their forward end by two front legs 70 and 71 by rounded corners 72 and 73. Thus, the entire main frame member 60 may be made from a single piece of metal tubing bent to shape.

The two rear leg members 61 and 62 are preferably identical, each of them having an upper back-supporting portion 74 and 75, each preferably having a rearwardly inclined portion 76 or 77. The upper end of each upper back-supporting portion 74, 75 terminates in an oblique edge 78, 79, which is planar along a steeply sloping, nearly vertical plane.

The very important frame-connecting and spacing members 63 and 64 are illustrated in enlarged form in FIGS. 10 to 19, 23 and 24. They are symmetric to each other and, when attached, are cup-like in shape and, from above appear somewhat trapezoidal. Thus, it has a generally trapezoidal, essentially flat, upper horizontal wall portion 80 from which depend vertical side walls 81 and 82, via downwardly curving corners. At the opposite ends of the upper wall 80 are a long, mostly curved horizontal edge 83 and a shorter semicircular horizontal edge 84. The edge 84 has a radius to fit its leg member 61 or 62 and is welded thereto. The edge 83 is curved to match the curve 68 or 69 where it abuts it. The vertical side walls 81, 82 have vertical edges 85, 86, 87, and 88. The edge 83 and the edges 85 and 87 form a continuous edge which is welded by any suitable welding technique to the main frame member 60. The location is important, and the connecting members 63 and 64 are continuously shaped to fit the frame member 60 at an exact spot, near and along part of the corners 68 and 69 and preferably including a portion thereof, but also partly along the rear end of the side members 66 and 67 so that the members 63 and 64 will act to space the rear legs 61 and 62 out laterally from the frame 60. The edges 86 and 88 may be straight, to abut the rear leg 61 or 62, but the edges 85 and 87 are curved to match the contour of the side rail 66 or 67 and other portions of the frame 60 they are to abut, as shown at 89 and 90. The securing to the rear legs 61 and 62 is done along the edges 84, 86, and 88, which also lie as a continuous edge, and again, welding is used.

The result is that the members 63 and 64 and the welding provide the sole rigid connections between the shaped frame members. Thus, the two connecting and spacing members 63 and 64 rigidly connect the rear legs 61 and 62 to the frame member 60 at a point near the back thereof and spaces the rear legs 61 and 62 out laterally sufficiently so that the chair 50 or 56 can stack. The legs 61 and 62 are therefore farther apart than the legs 70 and 71 at the front, at least by the thickness of the frame members. To assure maximum strength of these important connections, all of the joining edges 83, 84, 85, 86, 87, and 88 are welded throughout their full length to the frame tubes 61 and 66, 68 or 62 and 67, 69. The welding is all done from below and inside the box-like configuration, so that the whole gives a clean appearance, eliminating the need for finishing off the welds, shown at 79 and 86.

Figures 15, 16:
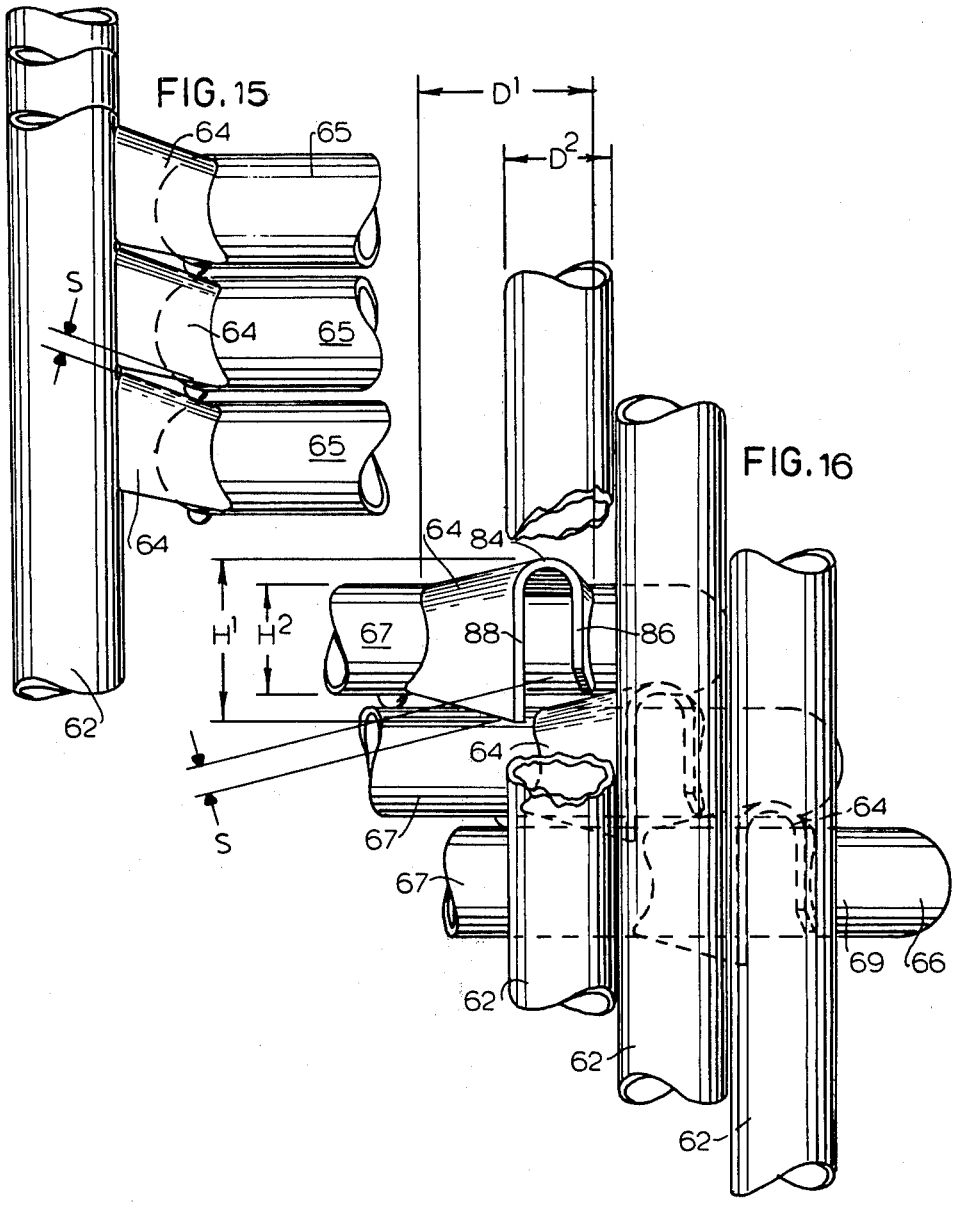
FIG. 15 is a fragmentary view in rear elevation of segments of three armchairs of FIGS. 1–9 in a stack showing the frame-connecting-and-spacing member of FIGS. 10–14 connecting two frame members of each armchair together.
FIG. 16 is a fragmentary view in side elevation of the left side of the same portion of the same three armchairs.

FIGS. 15 and 16 show some interesting features relating to the members 63 and 64. The vertical extent of the contact between the member 63 or 64 and the rear leg 61 or 62 (along the edges 84, 86, and 88) is shown at $H^1$ and is preferably greater than the diameter $H^2$ of the seat frame tubing. Also, the horizontal extent $D^1$ of contact between the member 63 or 64 and the seat frame 60 (along the edges 83, 85, and 87) should be greater than the diameter $D^2$ of the seat frame tubing. Preferably, $D^2=H^2$, and the thickness of the metal members 63 and 64 is the same as that of the members 60, 61, and 62, to assure evenness in temperature during welding. The spacing must be sufficient to achieve the difference between the distance between the rear legs and that of the front legs needed for stacking. The members 63 and 64 are so shaped and located that they do not interfere with the compact stacking and do not engage their corresponding parts on other chairs when the chairs are stacked.

It probably needs to be emphasized that this provision of these two simple connecting members which are symmetrical to each other, form the sole rigid connections of the frame members, and that as a result there can be considerable flexibility in the portions of the frame 51 that are remote from these connecting members 63 and 64, even though the frame 61 is preferably made from tubular steel. For the frame 61 to be rigid there would have to be some additional members rigidly securing the front legs 70 and 71 together or securing the side members 66 and 67 together. While such rigidity might be feasible, it is not considered desirable.

The side portions 66 and 67 preferably diverge from each other to rear and front so that the distance between the front legs 70 and 71 is preferably at least 5% greater than the distance they would be if they were truly parallel and to which they are usually held by the seat 52 or 57. Similarly, the upper ends of the back portions 74 and 75 preferably diverge from the connection members 63 and 64 so that the distance between them is preferably at least 5% greater than the distance to which they are brought by the back 53 or 58 in the preferable constructions. This enables spreading and, as it will be seen later, the same absence from rigidity has advantages in enabling the user to sit comfortably on an uneven surface.

The arms 54 and 55 are generally parallel but may diverge slightly. Each arm 54 and 55 has a generally horizontal front portion 201 or 202 and a steeply sloping rear portion rear portion 203 or 204, preferably made integrally from bent tubular stock identical to that of the other frame members. Each of the rear portions 203, 204 terminates in a hemispherical end and an inboard length 205, 206, mates exactly with and is welded to the oblique planar edge 78 or 79. The rear portions 203, 204 beyond the length 205, 206 diverge from the members 74 or 75. Thus, the arms 54 and 55 are located at a convenient height and are firmly made part of the frame 51. Their respective inner surfaces lie outboard of the outer surfaces of the rear legs to facilitate stacking.

Figures 20, 21, 22:
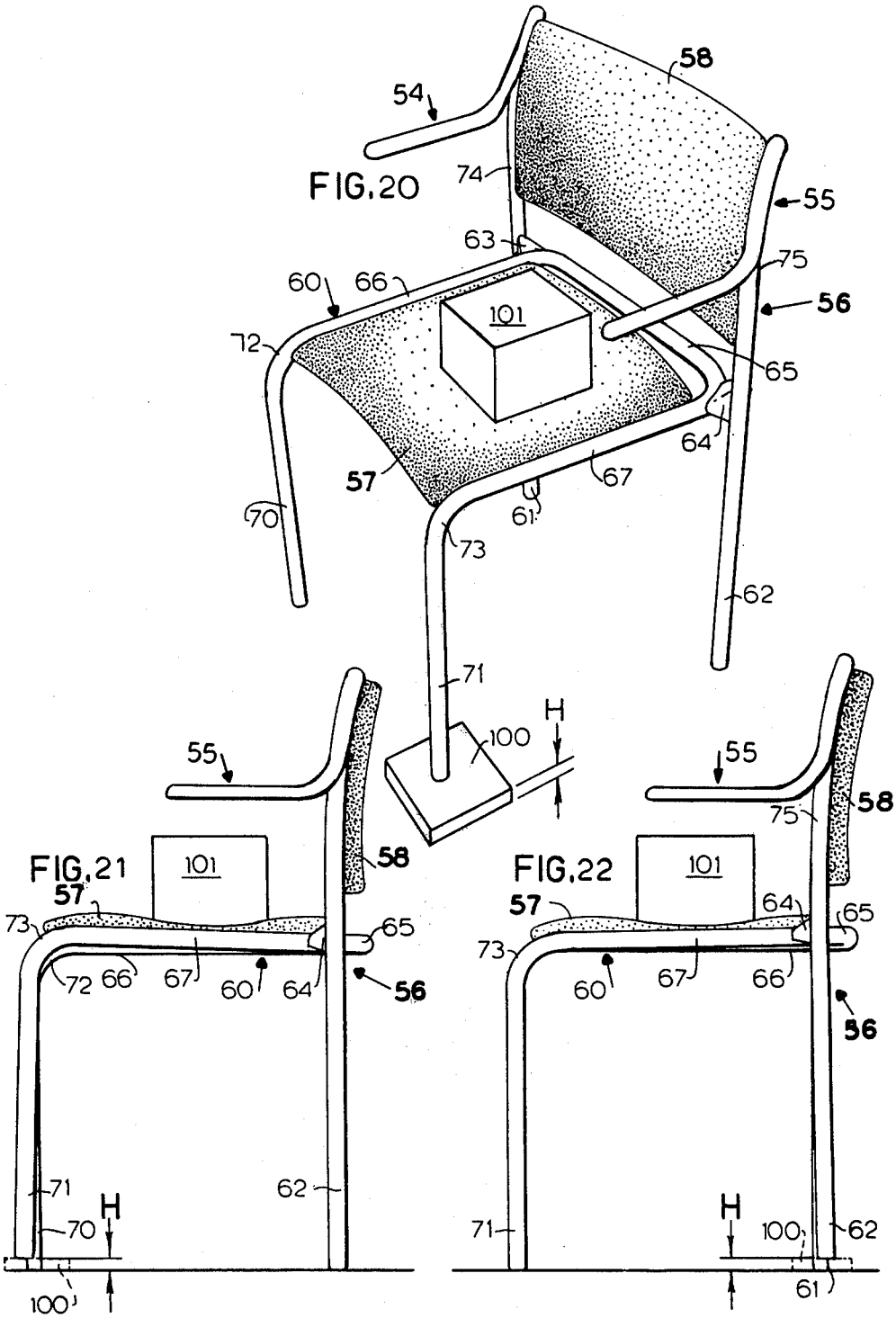
FIG. 20 is a view in perspective of an armchair like that of FIGS. 6 and 7 showing how the frame is able to adjust to an uneven surface so that the frame will be stable even on an uneven surface. The left front leg is shown elevated on a block, and a weight is shown on the seat to illustrate that the weight, by flexing the frame, achieves the needed adjustment of the frame.
FIG. 21 is a view in side elevation of the armchair of FIG. 20.
FIG. 22 is a view like FIG. 21, but here the left rear leg is the one that is supported high.
Figure 25:
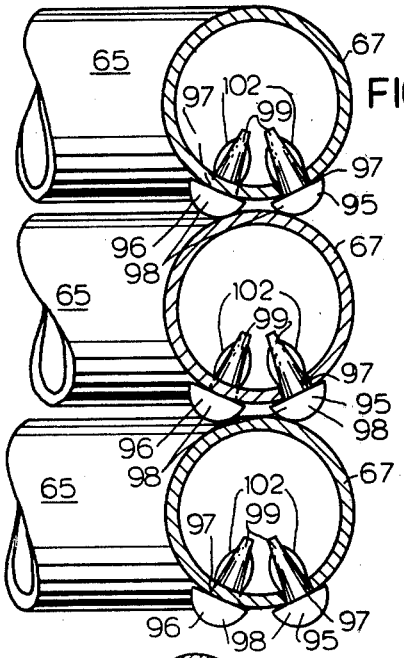
FIG. 25 is a further enlarged view partly in vertical section through the front of the stacked frame side portions, looking rearwardly and showing the two spacer members which keep the frames from scratching each other during stacking and unstacking.
Figure 23:
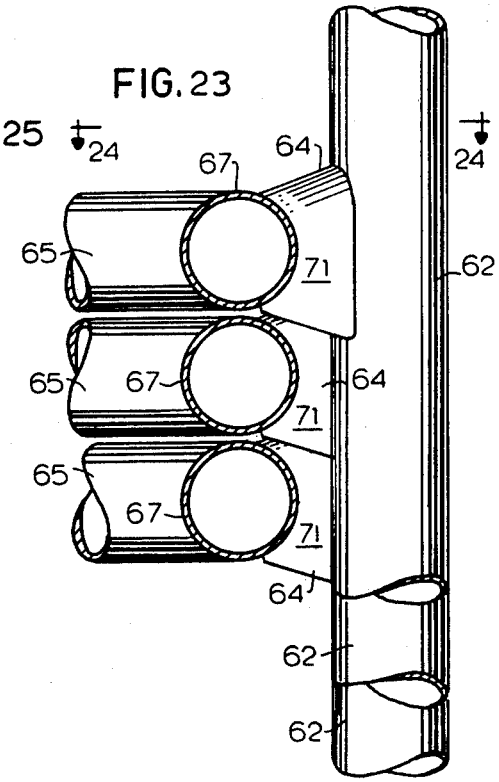
FIG. 23 is an enlarged fragmentary view, partly in vertical section, of a portion of three stacked armchairs, taken along the line 23—23 in FIG. 24.
Figure 27:
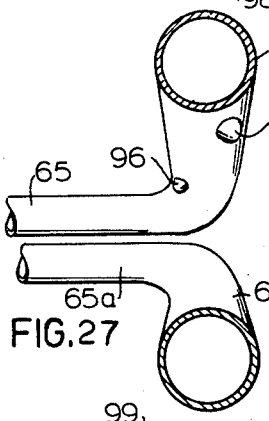
FIG. 27 is a view in vertical section taken through the side rails of two chairs, looking rearwardly, with the two about to be stacked, one being inclined down from the rear and the other upwardly from the rear.
Figure 24:
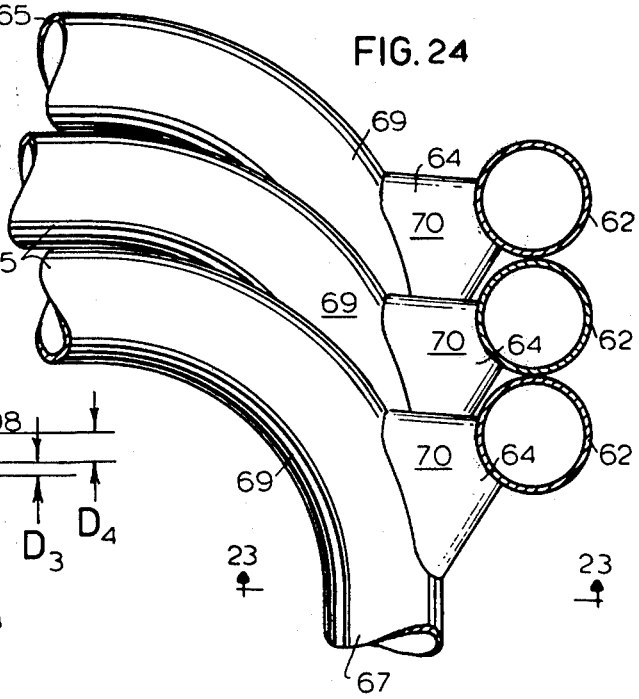
FIG. 24 is a view partly in horizontal section of the portions shown in FIG. 23, taken along the line 24—24 in FIG. 23.

Adaptation to an irregular surface (FIGS. 20–22)

As FIGS. 20, 21 and 22 show, the present invention enables the armchair 50 or 56 to adjust itself easily to an uneven surface. This is a very important feature of the invention made possible by the fact that the sole rigid connections between the frame members 60 and the frame members 61 and 62 is that supplied by the connection and spacing members 63 and 64. Thus, as shown in FIGS. 20 and 21, the left front leg 71 is placed up on a block 100 and a weight 101 is set on the seat 46. The block 100 corresponds to an uneven surface, as on an outdoor terrace or sidewalk, and the weight 101 corresponds to a sitter. As long as the weight 101 is at least about 25 kg., the chair will adjust itself so that it will not feel tippy or unstable even though the bottoms of the legs are at different levels. The height H of the block 100 shown in FIG. 21, which is made to scale, can be as much as one centimeter (ten millimeters). FIG. 22 shows that the same thing applies just as well for a rear leg 62 being the one where the rise in the ground surface is.

Figure 8:
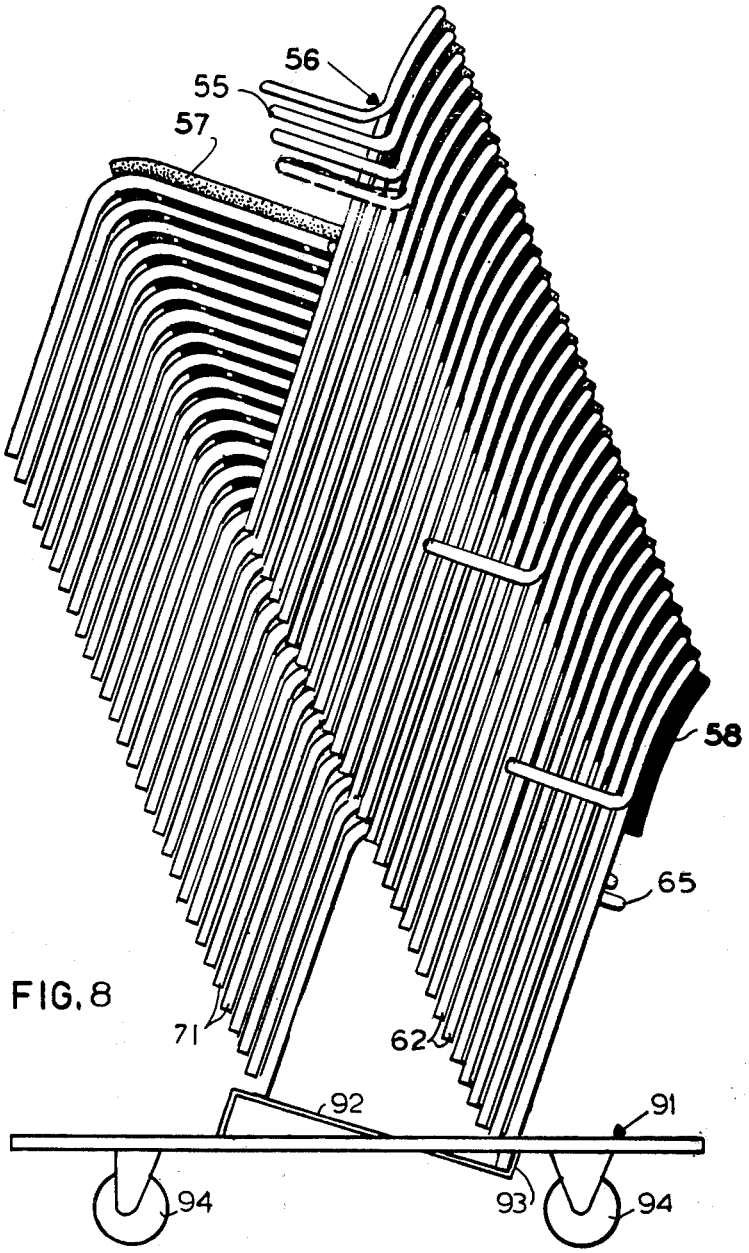
FIG. 8 is a view in side elevation of a stack of armchairs like that of FIGS. 6 and 7, supported on a transporting dolly, some arms being omitted for greater clarity.
Figure 9:
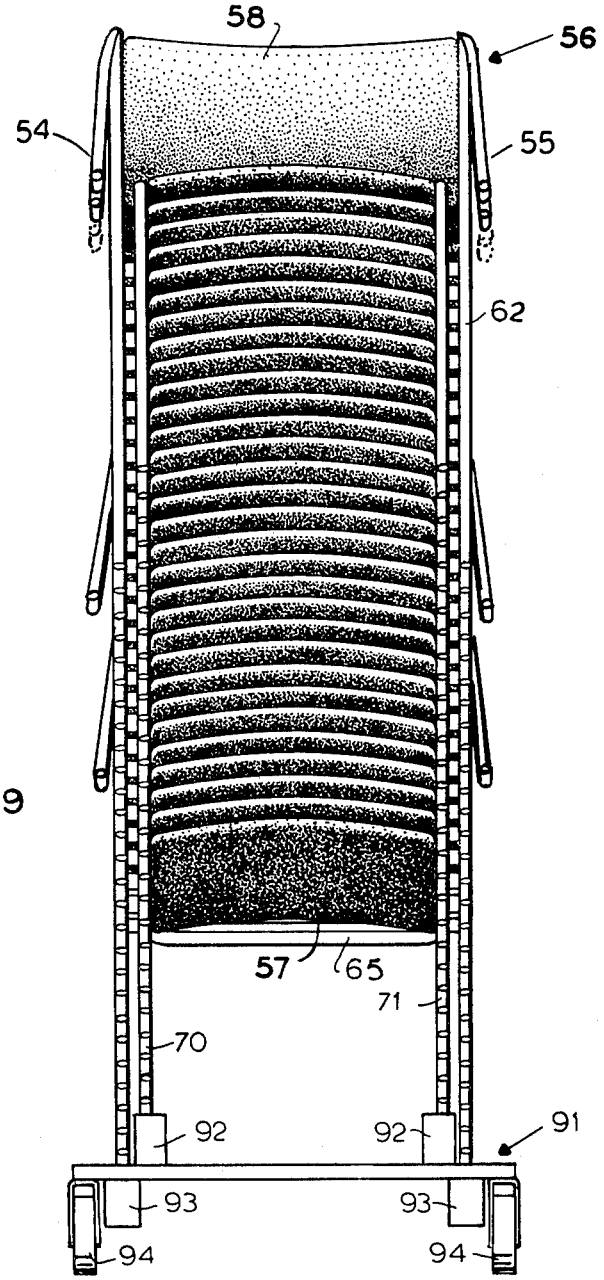
FIG. 9 is a view in front elevation of the stack of FIG. 8.
Figure 11:
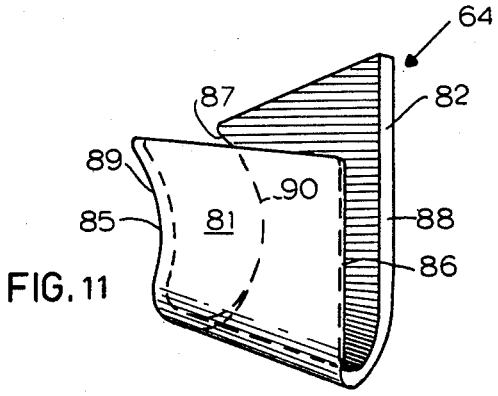
FIG. 11 is a view in rear elevation of the frame-connecting-and-spacing member of FIG. 10.
Figure 12:
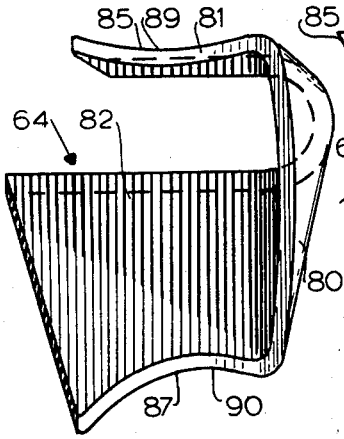
FIG. 12 is a right side elevation thereof.
Figure 10:
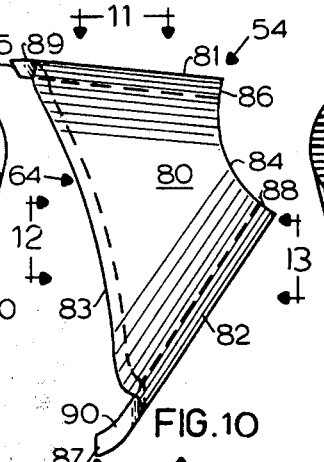
FIG. 10 is a top view of a left-hand, frame-connecting-and-spacing member employed in the armchairs of FIGS. 1–9.
Figure 13:
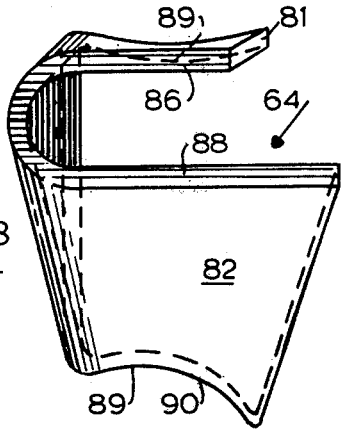
FIG. 13 is a left side elevation thereof.
Figure 14:
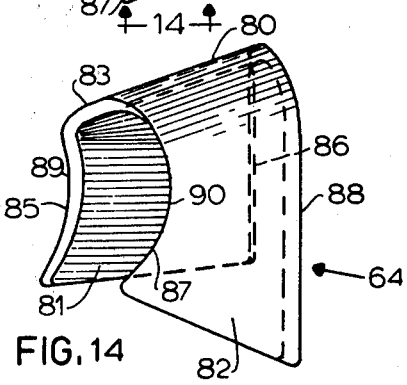
FIG. 14 is a front view thereof.

The stackability of the armchairs (FIGS. 8 and 9)

FIGS. 8 and 9 show that the armchairs 50 or 56 can be made very compactly stackable. The actual stack height per chair depends on the thickness of the frame members and on the spacing between them, which is kept quite close. Generally speaking, the seat 52 or 57 and back 53 or 58 are made thinner than the frame 51 and do not enter into consideration for compactness of stacking. As shown, the stacked armchairs in large groups are preferably supported on a dolly 91 having an inclined portion 92 and inclined back 93 for supporting both the front and rear legs of the bottom armchair and a portion of the rear legs leading up at the back. The subsequent stacking is then supported by the dolly 80 which, having wheels 94, can be moved from place to place.

Spacing during stacking (See FIGS. 7–9 and 25–27)

Figures 17, 18, 19, 29, 30:
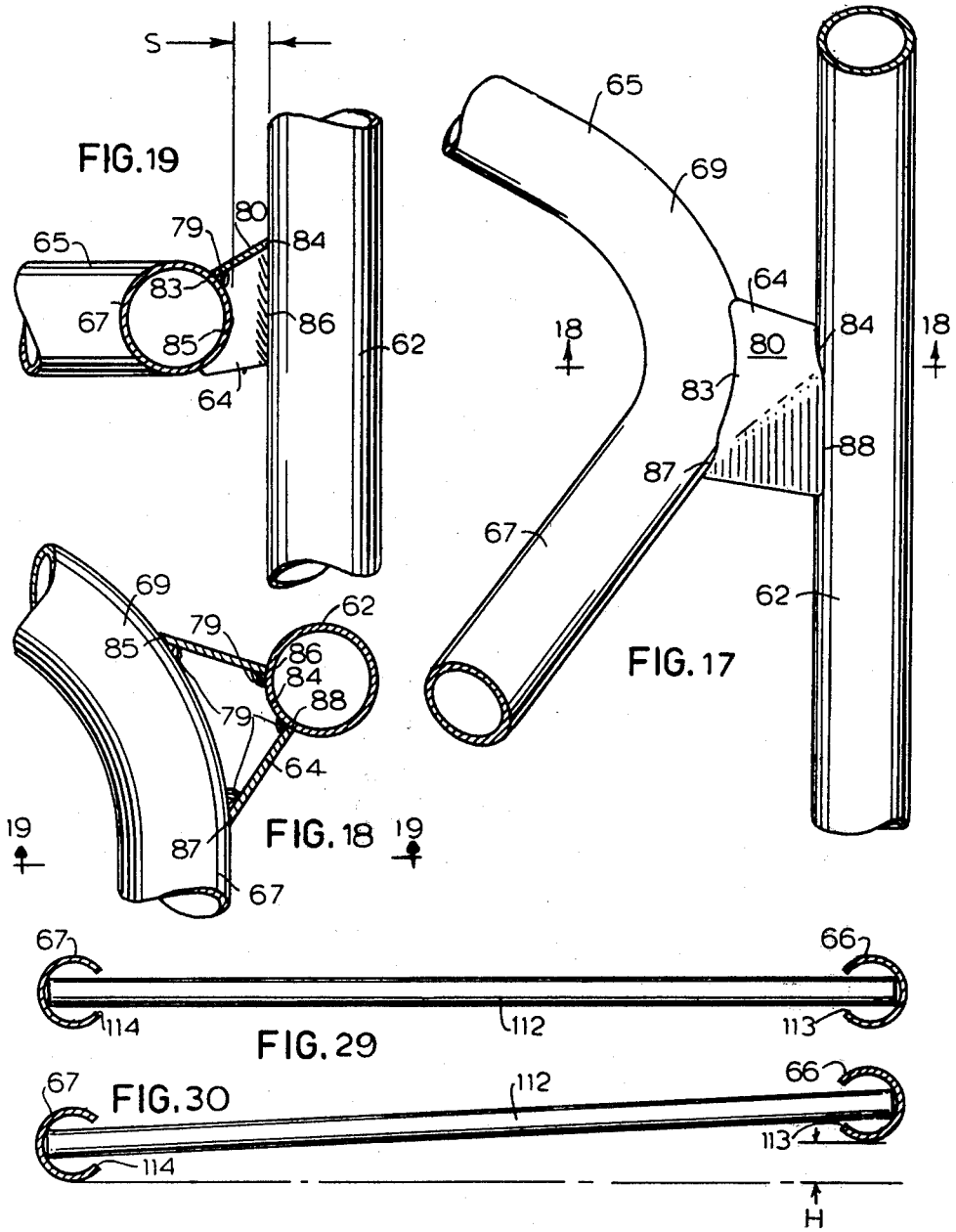
FIG. 17 is a fragmentary enlarged view in perspective of a portion of the frame of FIGS. 1–3, showing how a frame-juncture-and-spacing member joins a rear leg to the main frame element and spaces the rear legs apart farther than the side portions and front legs.
FIG. 18 is a view in section taken along the line 18—18 in FIG. 17.
FIG. 19 is a view in section taken along the line 19—19 in FIG. 18.
FIG. 29 (on the same sheet as FIGS. 17–19) is a view in section along the line 29—29 in FIG. 28 illustrating an unflexed position.
FIG. 30 (on the same sheet as FIGS. 17–19) is a view similar to FIG. 29 illustrating a flexing position that can be obtained in the same structure.
Figure 26:
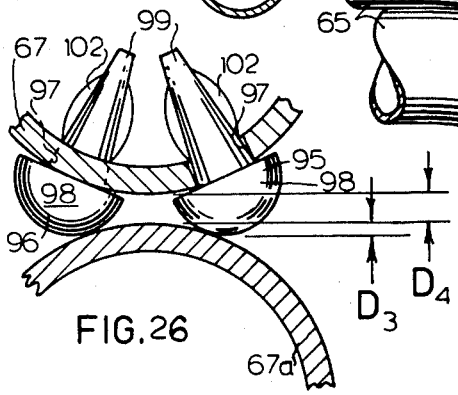
FIG. 26 is a still further enlarged view of a portion of FIG. 25.

The stacking, as shown in the drawings, calls for a buffering or spacing of the successive frames 51 from each other by a small amount in order to prevent the frames 51 from scratching each other during stacking and unstacking. For this purpose, a pair of plastic separators 95 and 96 are used on each side frame member 66, 67. The separators 95 and 96 are preferably identical, and they may be in the form of hole plugs secured to the main frame member 51. Preferably, they are located on the side members 66 and 67, one being located near the front thereof and the other near the rear, as shown in FIG. 3. In each instance, a hole 97 is drilled through the side member 66 and 67 to take each separating member 95, 96. The members 95 and 96 are preferably made of plastic, and each has a rounded head 98 and a generally conical stem 99 with a pair of flexible fins 102 that hold the stem 99 in place once it is inserted through the opening 97. Thus, the fins 102 tend to fold to permit entry of the stem 99 into the opening 97, but once through the opening 97, the fins 102 are difficult to retract. Only the heads 98 project from the openings 97, and they are held in place by the stem 99 and fins 102 so that they are held very close to the frame member, projecting only a sufficient amount to prevent the frames 51 from touching each other. These two plugs 95, 96 on each side are set so that one (either one) faces inwardly of the chair frame 51 and the other faces outwardly, providing a trough between them that helps to keep the stacked armchair frames 51 vertically aligned while at the same time providing the needed protection against abrasion. Thus, the distance $D_3$ shown in FIG. 26 is the distance between the point where the separator 95 bears against the chair frame member 67A below it and the actual top of that frame, while the distance $D_4$ is the spacing between the two frame members 67 and 67A as a result of this expedient. Therefore, as can be seen from FIGS. 23 to 25 (as well as in FIGS. 8 and 9), the stacking can be compact while direct frame contact is avoided, even at the arms. The spacing S is also shown in FIGS. 16 and 17.

Figure 4:
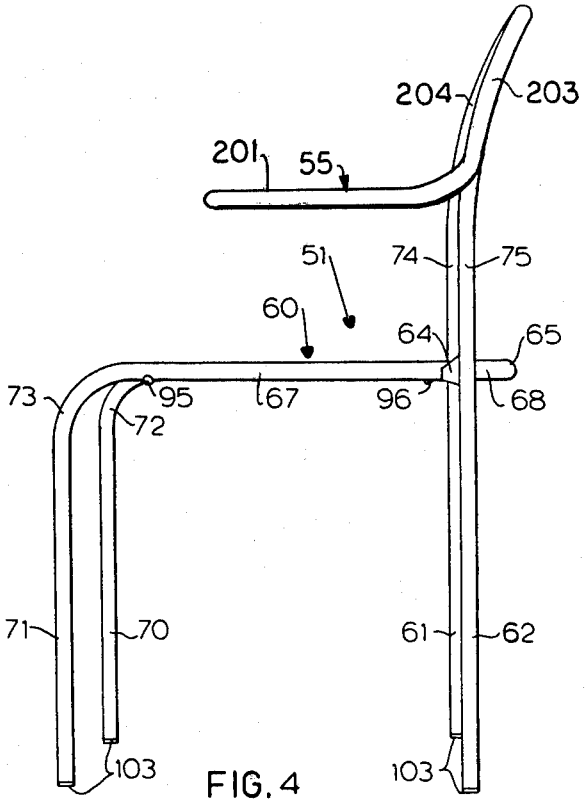
FIG. 4 is a perspective view from one side of the armchair frame of FIG. 1.

Glides (FIGS. 3, 4, and 7)

Suitable glides 103 may be used to support the armchair, and if the stock is tubular, then the glides 103 may be as shown in FIG. 7, each having a stem portion 104 that is inserted up into each leg and fits snugly in the interior of the leg, and also having an exterior portion 105 which has preferably substantially the same diameter as the armchair legs 61, 62, 70, and 71. This helps to make a very trim-looking armchair.

Attachments for securing the SOFLEX ® seats and backs (FIGS. 2 and 7)

The armchair frame 51 as shown in FIGS. 2 and 7 is preferably provided with a pair of seat-securing members 106 and 107 and a pair of back-securing members 108 and 109. These members 106, 107, 108, and 109 are clip-strips welded onto the side frames 66 and 67 for the seat and to the back members 74 and 75 for the back and have projections 110 that enable a rapid and secure affixation of the seat 52 or 57 and the back 53 or 58. Hooks on the ends of the seat 52 or 57 and back 53 or 58 engage the projections 110, which then hold them in place. The projections 110 may then be crimped around the end hooks. The attachment of the seat and back urges the side members 66 and 67 and the back members 74 and 75 to a more nearly parallel position. This, too, is an important feature of the invention and flows partly from the members 63 and 64 providing the sole rigid frame connections.

Figure 28:
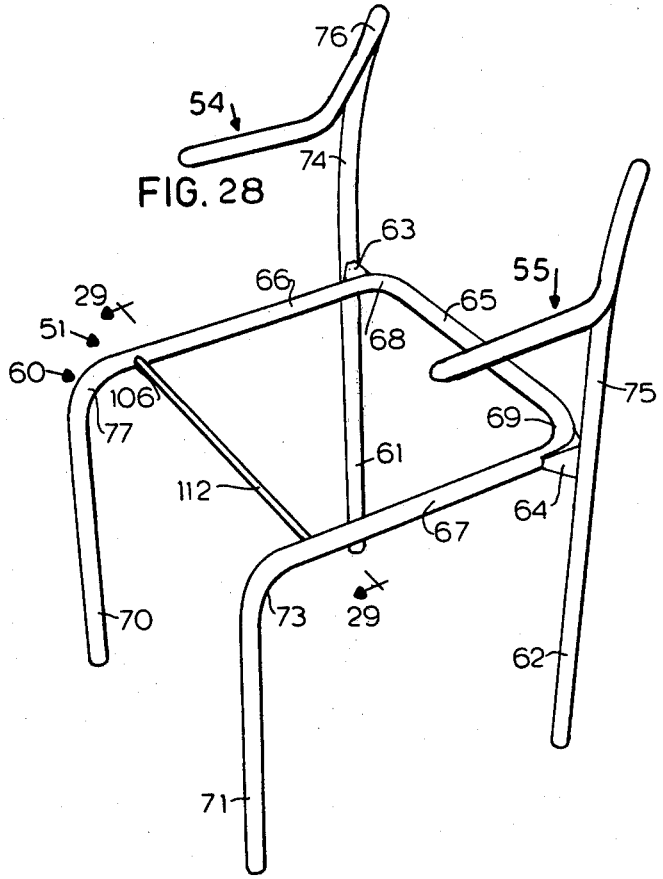
FIG. 28 is a perspective view of a modified form of armchair frame of this invention in which a free-floating rod or tube is placed in a non-rigid manner across the two side portions.

Use of a free-floating stretcher (FIGS. 28–30)

As shown in FIGS. 28–31, a free-floating stretcher rod 112 may be used to prevent any tendency of the armchair 50 to collapse with soft upholstery. For this purpose, two openings 113 and 114 are drilled into the inside wall of the respective side members 66 and 67, and the rod 112, significantly smaller in diameter than either of these openings 113 and 114, is inserted to bridge the distance between the side members 66 and 67 and to extend into the frame to a position where it is capable of bearing against the opposite wall thereof. When the seat 52 or 57 is in place and no one is sitting on it, the rod 112 prevents any tendency for the armchair to be collapsed inwardly by abusive compressive forces; at the same time, since the connection is not rigid, it also perpetuates the frame's flexibility when the armchair is being sat upon and enables the desired vertical movement for a type of knee action that enables the armchair to adjust to uneven base surfaces, as just described above, the same dimension H shown in FIGS. 20–22 being shown in FIG. 30.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A frame for a stacking chair, including in combination:

a main frame element having a U-shaped, horizontal portion from which extends a pair of vertical front legs, said U-shaped portion having a rear, horizontal lateral stretcher portion joined at each end by a curved corner to a horizontal side portion, each of which is joined by a curved corner to a said front leg, said front legs being substantially parallel to each other and said side portions being generally parallel to each other, but diverging somewhat from rear to front, a pair of frame-juncture-and-spacing members, each having a generally horizontal portion with a pair of opposite generally horizontal edges and a generally vertical portion having a pair of generally vertical edges, each continuous with a said horizontal edge, one said horizontal edge and one vertical edge of each frame juncture member being secured to the side of said main frame element adjacent to one of the corners at each end of said lateral portion and extending laterally beyond said side portions, frame means for providing a pair of separate rear legs each having an upwardly extending back-support portion, each said rear leg being secured to the other said horizontal edge and to the adjacent vertical edge of a said frame-juncture-and-spacing member and held thereby at a distance apart greater than the distance between the outermost portions of said side members, said back-support portion terminating at the upper end in an oblique edge surface, said back support portions being generally parallel to each other but diverging somewhat upwardly, and a pair of arm members each having an inboard rear surface welded to the oblique edge surface of said back-support portion and extending downwardly and forwardly therefrom and a generally horizontal forward portion continuous with said rear portion, and arms being substantially parallel with each other, but diverging somewhat from top to bottom and the inner surfaces thereof lying outboard of the outer surfaces of the rear legs.

2. The frame of claim 1 wherein each said frame-juncture-and-spacing member has a generally horizontal top wall portion with a pair of opposite generally horizontal edges and a pair of opposite generally vertical wall portions extending down in between said horizontal edges, each vertical portion having a pair of generally vertical edges, each continuous with a said horizontal edge, one said horizontal edge and two adjacent said vertical edges of each frame juncture member being shaped to fit and secured to the side of said main frame element adjacent to one of the corners at each end of said lateral portion and extending laterally beyond said side portions, the other said horizontal edge and the adjacent two vertical edges being shaped to and secured to a said rear leg.

3. The frame of claim 2 wherein said main frame element and said rear legs are tubular metal and said frame-juncture-and-spacing member is metal and has a short arcuate horizontal edge for welding to said rear leg and a wider horizontal edge for welding to said main frame element, the generally horizontal top wall portion being substantially wider than the diameter of the tubular metal frame, said generally vertical walls being higher than the diameter of said tubular metal frame.

4. The frame of claim 3 wherein the welds are below said generally horizontal top wall portion and on the inside edges of said generally vertical side wall portions, so that the welds are generally hidden from view.

5. The frame of claim 1 wherein there is a single upper portion as said generally vertical portion and formed at its lower end into a single horizontal portion comprising said generally horizontal portion.

6. The chair frame of claim 1 wherein said frame-juncture-and-spacing means is the only means connecting separate frame elements to each other and said lateral portion is the only rigid member rigidly connected to said side portions.

7. The chair frame of claim 1 wherein said main frame element is formed from a single length of tubular metal.

8. The chair frame of claim 1 or 7 wherein said main frame element, said metal frame means, and said arms are formed from the same tubular metal stock.

9. The chair frame of claim 8 wherein each said side portion is provided with two openings on its lower surface, the openings being spaced apart from front to rear and also spaced on opposite sides of the center of the lower surface, and two plastic members each secured in one said opening, so that one plastic member is near the front of said chair frame and one near the rear thereof, each plastic member having a portion projecting out from its said opening, one facing inwardly, and one facing outwardly of the chair, thereby providing spacing and scratch protection to said frame when a plurality of identical such chair frames are stacked on each other.

10. The chair frame of claim 8 having tubular legs and a bottom glide for each leg comprising a plastic member with a shank portion inserted inside the tubular leg and an enlarged outer portion of the same diameter as the leg.

11. The chair frame of claim 1 having secured to each said side portion and to each said back-support portion anchor means for securing said seat and said back to said frame.

12. The chair frame of claim 1 wherein there are horizontal openings near the front of said side portions, said openings facing each other and aligned with each other and a rigid member bridging said side portions and inserted loosely in both said openings, the rigid member being smaller in diameter than the openings.

13. A frame for a stacking chair, including in combination:

a main tubular metal frame element having a U-shaped, horizontal portion with a pair of side rails from which extend a pair of vertical front legs, said side rails being joined by a rear, horizontal lateral stretcher portion joined at each end by a curve to a said side rail, each of which is joined by a curve to a said front leg, said front legs being substantially parallel to each other and said side portions being generally parallel to each other, but diverging somewhat from rear to front, a pair of one-piece metal frame-juncture-and-spacing members, each having a generally horizontal top wall with a pair of opposite generally horizontal edges and a pair of opposite generally vertical walls between said horizontal edges, each vertical wall having a pair of generally vertical edges, each continuous with a said horizontal edge, one said horizontal edge and two adjacent said vertical edges of each frame juncture member being shaped to conform to and welded to said main frame element along a side rail and partially around one of the corners at each end of said stretcher portion and extending laterally beyond said side rails, a pair of separate tubular metal frame means for providing a pair of rear legs each having an upwardly extending back-support portion, each said rear leg being welded to the other said horizontal edge and to the adjacent vertical edge of a said frame-juncture-and-spacing member and held thereby at a distance apart greater than the distance between the outermost portions of said side members, said frame-juncture-and-spacing means being the only means connecting separate frame elements to each other, said stretcher portion being the only lateral rigid member rigidly connected across the frame, and said back-support portion terminating at the upper end in an oblique edge surface, said back support portions being generally parallel to each other but diverging somewhat upwardly, and a pair of arm members each having an inboard rear surface welded to the oblique edge surface of said back-support portion and extending downwardly and forwardly therefrom and a generally horizontal forward portion continuous with said rear portion, said arms being substantially parallel with each other but diverging somewhat from top to bottom, the arms' inner surfaces lying outboard of the outer surfaces of the rear legs.

14. The chair frame of claim 13 wherein each said side rail is provided with two openings on its lower surface, the openings being spaced apart from front to rear and also spaced on opposite sides of the center of the lower surface, and two plastic members each secured in one said opening, so that one plastic member is near the front of said chair frame and one near the rear thereof, each plastic member having a portion projecting out from its said opening, one facing inwardly, and one facing outwardly of the chair, thereby providing spacing and scratch protection to said frame when a plurality of identical such chair frames are stacked on each other.

15. The chair frame of claim 13 having secured to each said side rail and to each said back-support portion anchor means for securing said seat and said back to said frame.

16. The chair frame of claim 13 wherein there are horizontal openings near the front of said side portions, said openings facing each other and aligned with each other and a rigid rod bridging said side portions and inserted loosely in both said openings, the rod being smaller in diameter than the openings.

17. A stacking chair, including in combination:

a main frame element having a U-shaped, horizontal portion from which extend a pair of vertical front legs, said U-shaped portion having a rear, horizontal lateral stretcher portion joined at each end by a curved corner to a horizontal side portion, each of which is joined by a curved corner to a said front leg, said front legs being substantially parallel to each other and said side portions being generally parallel to each other, but diverging somewhat from rear to front, a pair of frame-juncture-and-spacing members, each having a generally horizontal portion with a pair of opposite generally horizontal edges and a generally vertical portion having a pair of generally vertical edges, each continuous with a said horizontal edge, one said horizontal edge and one vertical edge of each frame juncture member being secured to the side of said main frame element adjacent to one of the corners at each end of said lateral portion and extending laterally beyond said side portions, and frame means for providing a pair of rear legs each having an upwardly extending back-support portion, each said rear leg being secured to the other said horizontal edge and to the adjacent vertical edge of a said frame-juncture-and-spacing member and held thereby at a distance apart greater than the distance between the outermost portions of said side members, said back-support portions being generally parallel to each other and terminating at the upper end in an oblique edge surface, said back support portions being generally parallel to each other but diverging somewhat upwardly, and a pair of arm members each having an inboard rear surface welded to the oblique edge surface of said back-support portion and extending downwardly and forwardly therefrom and a generally horizontal forward portion continuous with said rear portion, said arms being substantially parallel with each other but diverging somewhat from top to bottom, their inner surfaces lying outboard of the rear legs, a seat bridging and secured to said two side portions and urging them toward a truly parallel relationship, and a back, bridging and secured to said two back-support portions and urging them toward a truly parallel relationship.

18. The chair of claim 17 wherein each said frame-juncture-and-spacing member has a generally horizontal top wall portion with a pair of opposite generally horizontal edges and a pair of opposite generally vertical wall portions extending down between said horizontal edges, each said vertical portion having a pair of generally vertical edges, each continuous with a said horizontal edge, one said horizontal edge and two adjacent said vertical edges of each frame juncture member being shaped to fit and secured to the side of said main frame element adjacent to one of the corners at each end of said lateral portion and extending laterally beyond said side portions, the other said horizontal edge and the adjacent two vertical edges being shaped to and secured to a said rear leg.

19. The chair of claim 18 wherein said main frame element and said rear legs are tubular metal and said juncture and spacing member is metal and has a short arcuate horizontal edge for welding to said rear leg and a wider horizontal edge for welding to said main frame element, the generally horizontal top wall portion being substantially wider than the diameter of the tubular metal frame, said generally vertical walls being higher than the diameter of said tubular metal frame.

20. The chair of claim 19 wherein the welds are below said generally horizontal top wall portion and on the inside edges of said generally vertical side wall portions, so that the welds are generally hidden from view.

21. The chair of claim 17 wherein said frame-juncture-and-spacing means is the only means connecting separate frame elements to each other and said lateral portion is the only rigid member rigidly connected to said side portions.

22. The chair of claim 17 wherein said main frame element is formed from a single length of tubular metal.

23. The chair of claim 22 wherein said main frame element, said metal frame means, and said arms are formed from the same tubular metal stock.

24. The chair frame of claim 23 wherein each said side portion is provided with two openings on its lower surface, the openings being spaced apart from front to rear and also spaced on opposite sides of the center of the lower surface, and two plastic members each secured in one said opening, so that one plastic member is near the front of said chair frame and one near the rear thereof, each plastic member having a portion projecting out from its said opening, one facing inwardly, and one facing outwardly of the chair, thereby providing spacing and scratch protection to said frame when a plurality of identical such chair frames are stacked on each other.

25. The chair frame of claim 23 having tubular legs and a bottom glide for each leg comprising a plastic member with a shank portion inserted inside the tubular leg and an enlarged outer portion of the same diameter as the leg.

26. The chair frame of claim 17 having secured to each said side portion and to each said back-support portion anchor means securing said seat and said back to said frame.

27. The chair frame of claim 17 wherein there are horizontal openings near the front of said side portions, said openings facing each other and aligned with each other and a metal rod bridging said side portions and inserted loosely in both said openings, the rod being smaller in diameter than the openings.

28. The chair of claim 17 wherein said seat and said back are non-rigid and resilient with opposite ends of each connected rigidly to said two side portions and two back-support portions, respectively.

29. The chair of claim 17 wherein the vertical thickness of said seat and the horizontal thickness of said back are thinner than the thicknesses of said main frame element and of said frame means.

30. A stacking chair, including in combination:

a main tubular metal frame element having a U-shaped, horizontal portion with a pair of side rails from which extend a pair of vertical front legs, said side rails being joined by a rear, horizontal lateral stretcher portion joined at each end by a curve to a said side rail, each of which is joined by a curve to a said front leg, said front legs being substantially parallel to each other and said side portions being generally parallel to each other, but diverging somewhat from rear to front, a pair of one-piece metal frame-juncture-and-spacing members, each having a generally horizontal top wall with a pair of opposite generally horizontal edges and a pair of opposite generally vertical walls between said horizontal edges, each vertical wall having a pair of generally vertical edges, each continuous with a said horizontal edge, one said horizontal edge and two adjacent said vertical edges of each frame juncture member being shaped to conform to and welded to said main frame element along a side rail and partially around one of the corners at each end of said stretcher portion and extending laterally beyond said side rails, and tubular metal frame means for providing two completely separated rear legs each having an upwardly extending back-support portion, each said rear leg being welded to the other said horizontal edge and to the adjacent vertical edge of a said frame-juncture-and-spacing member and held thereby at a distance apart greater than the distance between the outermost portions of said side members, said frame-juncture-and-spacing means being the only means connecting separate frame elements to each other, said stretcher portion being the only lateral rigid member rigidly connected across the frame, said back-support portions being generally parallel to each other but diverging somewhat upwardly, said back-support portion terminating at the upper end in an oblique edge surface, said back-support portions being generally parallel to each other but diverging somewhat upwardly, and a pair of arm members each having a rear surface welded to the oblique edge surface of said back-support portion and extending downwardly and forwardly therefrom and a generally horizontal forward portion continuous with said rear portion, said arms being substantially parallel with each other but diverging somewhat from top to bottom and their inner surfaces lying outboard of the outer surfaces of the rear legs, a non-rigid, resilient seat bridging and secured to said two side portions and urging them toward a truly parallel relationship, and a non-rigid, resilient back, bridging and secured to said two back-support portions and urging them toward a truly parallel relationship.

31. The chair frame of claim 30 wherein the vertical thickness of said seat and said arms and the horizontal thickness of said back are thinner than the thickness of said frame element and said frame means, to enable compact stacking.

* * * * *